United States Patent [19]

Miyasaka et al.

[11] 3,979,902

[45] Sept. 14, 1976

[54] MOUNTING OF A CASE BAND AND A CRYSTAL BEZEL IN A WATCH

[75] Inventors: Tsutomu Miyasaka; Yoshiaki Fujimori; Youjiro Okakura, all of Suwa, Japan

[73] Assignee: Kabushiki Kaisha Suwa Seikosha, Tokyo, Japan

[22] Filed: May 20, 1975

[21] Appl. No.: 579,326

[30] Foreign Application Priority Data

May 22, 1974 Japan ..... 49-56613

[52] U.S. Cl. ..... 58/91

[51] Int. Cl.[2] ..... G04B 39/00

[58] Field of Search ..... 58/91

[56] References Cited

UNITED STATES PATENTS 1,839,041 12/1931 McCurdy ..... 58/91

3,292,362 12/1966 Klingenberg ..... 58/91

*Primary Examiner*—Edith Simmons Jackmon

*Attorney, Agent, or Firm*—Haseltine, Lake & Waters

[57] ABSTRACT

A watch case in which a bezel of a crystal and a case band are removably secured together by engagement of a plate spring secured to the bezel with an inclined surface of the case band. A waterproof relation can be obtained between the bezel and the case band by providing a gasket between the bezel and the case band. The plate opening has one portion secured in a recess of the bezel and a bent portion engaging the inclined surface.

7 Claims, 21 Drawing Figures

MOUNTING OF A CASE BAND AND A CRYSTAL BEZEL IN A WATCH

FIELD OF THE INVENTION

This invention relates to apparatus for securing together a bezel of a crystal and a case band of a watch case and particularly for securing a bezel of non-circular form to a case band of non-circular form.

PRIOR ART

Figure 1:
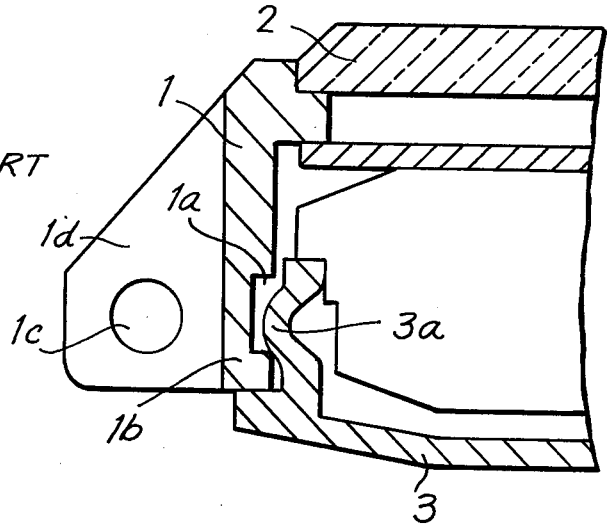
FIG. 1 PRIOR ART
FIG. 1 is a partial vertical section through a conventional non-circular watch case showing a bead engagement therein.

A conventional watch case is shown by way of example in FIG. 1, this watch case comprising a glass or crystal 2 secured as a unit to a non-circular case band 1 by an adhesive or the like, a bead 3*a* being formed on the outer periphery of a non-circular case back 3 and secured in a groove 1*a* provided at the inside surface of the lower portion 1*b* of the case band.

In this construction, it is necessary that the inner dimensions in a diametral direction of the non-circular case band 1 be about the same as the dimension in a diametral direction of the bead 3*a* on the non-circular case back 3 which results in the drawback that the lower portion 1*b* of the case band 1 becomes thick and the outer diameter of the watch case increases as a whole.

Accordingly, it is difficult to make the outer diameter of the watch case small and particularly it is impossible to produce a small-sized model in which a spring bar mounting for a watch band is incorporated into the case band, so that there are no other alternatives except to provide an opening 1*c* for the spring bar at the outside portion 1*d* of the case band 1 as shown in FIG. 1.

Further, there is the deficiency that the whole shape of the case band 1 is changed by plastic deformation because the inner portion 1*b* of the case band is stressed in the diametral direction at the time of engaging the bead 3*a* of the case back 3 in the groove 1*a* in the case band 1. For this reason, the adhesive joint for the crystal 2 is broken and portions of the adhesive can become cracked by the pressure in the diametral direction. These drawbacks bring about the undesirable result that water can easily enter the interior of the watch case through the unsealed portion of the crystal.

SUMMARY OF THE INVENTION

An object of the invention is to provide a watch construction in which the above-mentioned deficiencies are obviated.

A further object of the invention is to provide a watch construction which includes a thin and small size watch case in which the bezel and crystal are secured as a unit and such unit is resiliently engaged with the case band.

A further object of the invention is to provide a watch construction of the above character which is adapted to various shapes and designs of watch cases.

A further object of the invention is to provide a watch construction of the above character in which the waterproof relation of the crystal with the bezel is maintained when the bezel is engaged with the watch case. This objective is obtained by engaging the bezel from above without causing deformation of the bezel and thereby without imposing any stress on the adhesive joint between the crystal and the bezel.

A further object of the invention is to provide a watch construction of the above character in which the case can be of small size and thin dimension in which the spring bar is incorporated into the case band.

According to the invention there is provided an improvement in watch case construction wherein a spring member is secured to the bezel and it resiliently engages the case band to hold the same together.

According to a feature of the invention, the spring member is in the form of an elongated resilient element, a first portion of which is secured to the bezel and a second portion of which is bent away from the first portion and resiliently engages the case band.

According to a further feature of the invention the surface of the case band which is engaged with the bent portion of the resilient element is inclined with respect to the vertical.

According to still a further feature of the invention, the watch construction can be made waterproof by the provision of a sealing gasket between the bezel and the case band.

DETAILED DESCRIPTION

Figure 2:
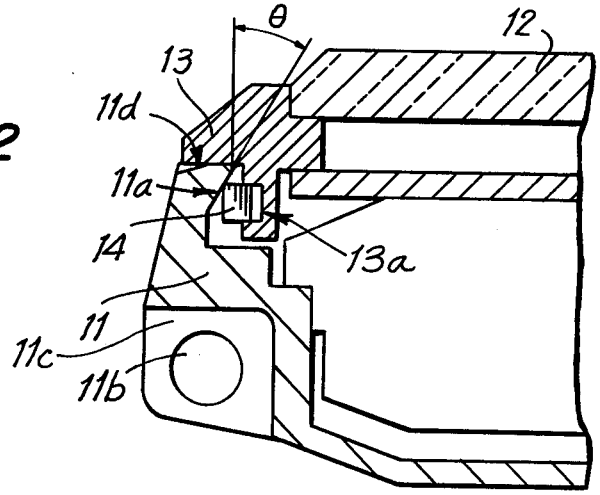
FIG. 2 is a partial vertical section showing one embodiment of a spring engagement according to this invention, FIGS. 3*a*–3*d* and 3*a*′–3*d*′ are respective plan and elevation views of modified versions of springs.
Figures 3A, 3B, 3C, 3D:
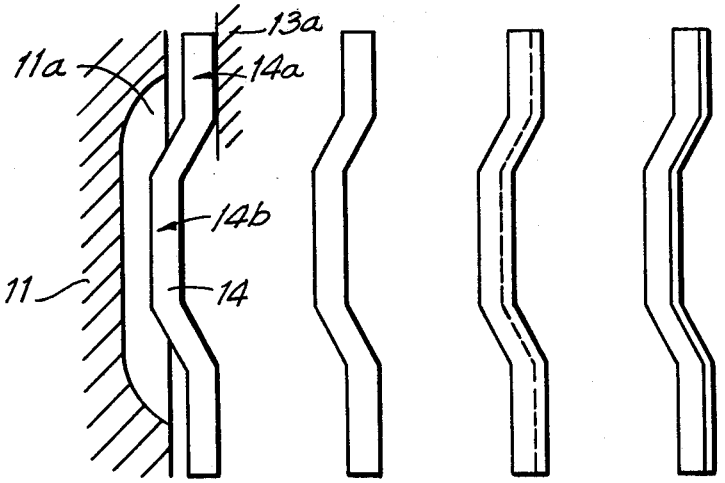
Figures 3A, 3B, 3C, 3D:
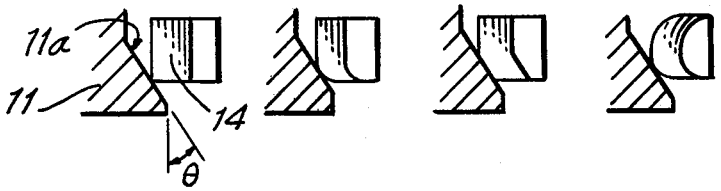

An embodiment of the invention will next be described in conjunction with FIG. 2. In FIG. 2, there is seen a bezel 13 to which a glass or crystal 12 is secured as a unit by an adhesive and adjacent the unit is a case band 11. Numeral 14 designates a spring member, one end of which is engaged in a groove 13*a* in the bezel 13 and secured thereto by means of welding, riveting or the like, the spring member 14 pressing and engaging against an inner inclined face 11*a* of a rim of the case band 11. The spring member 14 has the shape as shown in FIGS. 3*a*–3*d* wherein a central portion is bent outwardly and one end portion 14*a* of the spring member 14 is secured in the groove 13*a*. The spring member 14 provides a resilient mounting for the bezel, and the sectional shape of the spring member can have diverse shapes such as square, semicircular or a combination of curved lines and straight lines as shown in FIGS. 3*a*′–3*d*′. The inclined face 11*a* of case band 11 is formed at the central portion of the inner surface of the case band 11. To satisfy the condition that bezel 13 is to be secured to the case band 11, the angle of the inclined face 11*a* and the spring force of the spring member 14 are so adjusted that the central portion 14*b* of the spring member 14 has elasticity in a horizontal direction so that a force is developed in the vertical direction against the case band 11 which is always stronger than the force which operates to pull the bezel from the outside or the force which operates to remove the bezel by impact, for example, if the watch case is dropped.

It has been found that the angle $\theta$ of the inclined face 11*a* with respect to the vertical should be between 2° and 45° and the spring force between 1 and 5 kg in order to prevent the bezel from separation from the case band in practical use.

As mentioned above due to the elasticity of the spring member in the horizontal direction, it is possible to positively engage and secure the bezel to the case band without deforming the bezel to which the glass is adhesively secured as a unit. Only the bezel is engaged from above by the case band, so that it is possible to make the outer diameter of the case band 11 extremely small, and particularly the watch case can be made extremely small and thin because the opening 11*b* for the spring bar to which the watch band is fixed can be provided at an inside portion 11*c* of the case band 11. This enables producing a small model superior to the conventional one. At the same time, since the glass bezel can be secured to the case band without being deformed, pressure in the diametral direction is not also applied to the glass 12, so that the glass is not broken and the adhesive joint is not cracked. Accordingly, the waterproof relation between the glass 12 and the bezel 13 remains intact and its quality is very reliable.

With further reference to FIG. 2 numeral 11*d* designates a recessed portion in case band 11 for prying open the glass bezel. The recessed portion may be provided at any suitable location dictated by external appearance, for example, in the region of the twelve o'clock position.

Figure 4:
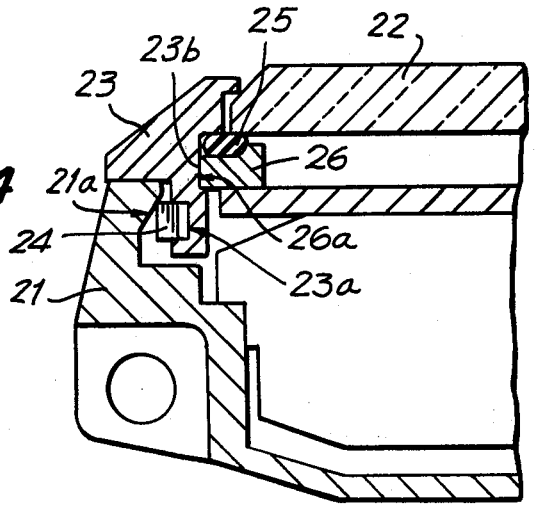
FIG. 4 is a partial vertical section of another embodiment according to this invention, FIGS. 5*a*–5*d* and 5*a*′–5*d*′ are respective plan and elevation views of modified versions of springs.
Figures 5A, 5B, 5C, 5D:
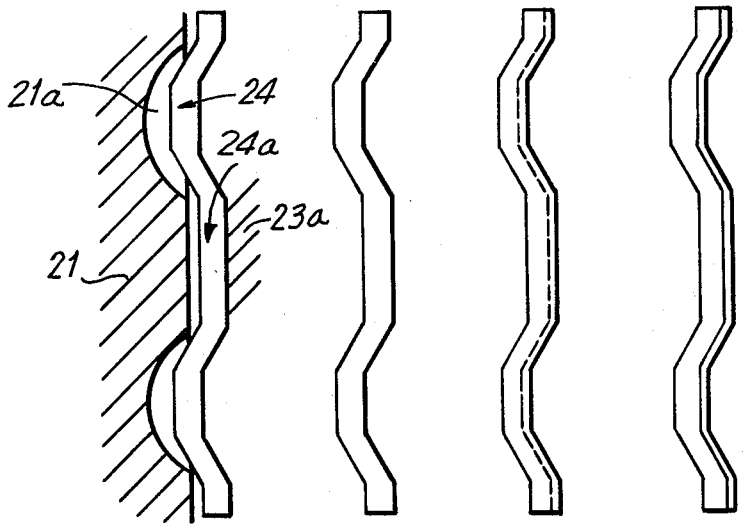
Figures 5A, 5B, 5C, 5D:
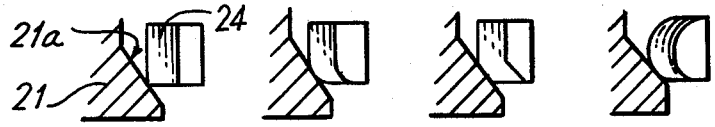

FIGS. 4 and 5*a*–5*d* show the engagement between glass bezel 23 and case band 21 not at a central portion of the spring member but at both ends of this spring member 24. Namely both ends of the spring member 24 are bent as shown in FIGS. 5*a*–5*d* and the central portion is secured in groove 23*a* in the glass bezel by means of welding, riveting or the like. Both ends of the bent spring member 24 have elasticity in the horizontal direction and the sectional shape of the member 24 may be square, semicircular or a combination of curved lines and straight lines. An inclined face 21*a* is provided at the inner surface of the case band 21, this surface having the same function as surface 11*a* in FIG. 2. FIG. 4 also shows the construction in which the glass 22 is secured to the glass bezel 23 not by means of an adhesive as in FIG. 2, but by clamping a gasket 25 carried by a ring 26 against bezel 23, the bezel 23 having a slightly inclined face 23*b* which tightly engages the outside surface 26*a* of the ring 26 when the latter is inserted in ring 26 and the gasket 25 engages the bezel 23 and the glass 22.

Figure 7:
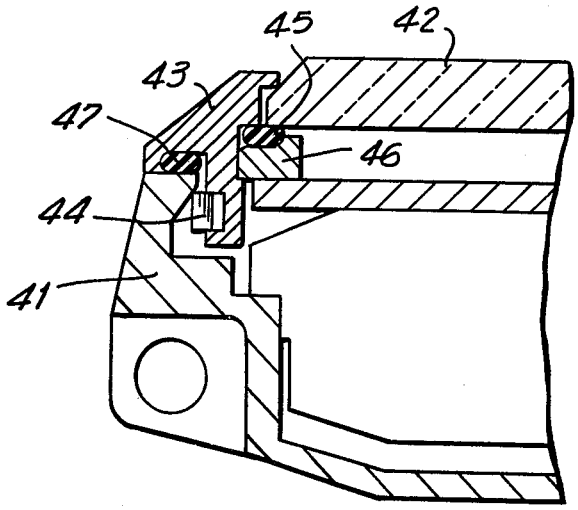
FIGS. 6 and 7 are partial vertical sections of further embodiments according to this invention.
Figure 6:
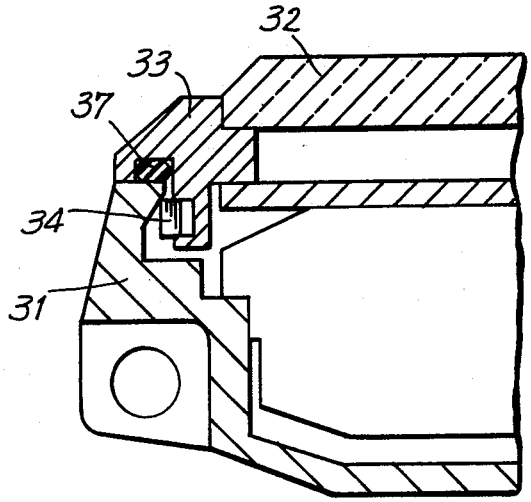

FIG. 6 shows a waterproof structure in which glass bezel 33 and case band 31 are sealed by providing a gasket 37 between the two. The construction is in other respects the same as the embodiment of FIG. 2 as can be seen by the relation of glass 32, bezel 33, spring member 34 and case band 31. The structure completely protects the movement therein. FIG. 7 shows a waterproof structure in which a gasket 47 is provided between the glass bezel 43 and the case 41, the construction otherwise being the same as in the embodiment of FIG. 4 as evident from the relation between glass 42, bezel 43, gasket 45, ring 46, spring member 44 and case band 41.

In the above described embodiments, the shape of the spring member is straight outside the band portion when the design of the watch case is rectangular as shown in the illustrated examples, however, when the watch design is circular or partially circular, the spring member becomes generally curved and the shapes of the case band and the glass bezel become circular or partially circular.

From the description, it is seen that the watch construction of the invention provides extremely small and thin watch cases which is advantageous from the design viewpoint and in which the waterproof condition of the glass portion is greatly superior in comparison with conventional watches whether the design is circular or non-circular.

What is claimed is:

1. A watch case construction comprising a first unit constituted by a case band, a second unit constituted by a bezel and a crystal secured to said bezel, a spring member secured to said bezel, said spring member including an elongated resilient element having a first portion secured to said bezel and a second portion bent away from said first portion, said case band including an upstanding rim having an outer peripheral surface and an inner surface with an inclined face, said second portion of the resilient element projecting outwardly and elastically engaging said inclined face to hold said units together.

2. The construction as claimed in claim 1 comprising a sealing gasket disposed between the bezel and the case band.

3. The construction as claimed in claim 1 wherein said bezel has a recess in which said first portion of the resilient element is secured, said second portion projecting radially outwards of said recess.

4. The construction as claimed in claim 3 wherein said first portion is a central portion of the resilient element.

5. The construction as claimed in claim 1 wherein said resilient element has opposite ends constituting said first portion, said bezel having a recess in which said ends are secured, said second portion of the resilient element being constituted by an intermediate section of the resilient element between said ends, said intermediate section projecting radially outwards from said ends.

6. The construction as claimed in claim 1 wherein said inclined face forms an angle with the vertical of 2 to 45° and the resilient element bears against the inclined face with a force of 1–5 kg.

7. The construction as claimed in claim 1 wherein said rim has an upper face and said bezel a lower face, which faces are brought into contact under the engagement of the resilient element with said inclined face of the case band.

* * * * *